US005608939A

United States Patent [19]

Waldhauser et al.

[11] Patent Number: 5,608,939

[45] Date of Patent: Mar. 11, 1997

[54] MOTOR AND DRIVER MOUNT DIAPHRAGM BURNISHER

[75] Inventors: Steve Waldhauser, Niagara Falls, N.Y.; Richard F. Wulff, Maple Plain, Minn.

[73] Assignee: Castex Incorporated, Holland, Mich.

[21] Appl. No.: 522,171

[22] Filed: Aug. 31, 1995

[51] Int. Cl.[6] ..... A47L 11/14; A47L 11/20

[52] U.S. Cl. ..... 15/98; 15/49.1; 15/385; 451/353

[58] Field of Search ..... 15/49.1, 98, 385; 451/353

[56] References Cited

U.S. PATENT DOCUMENTS

| | | | |
|---|---|---|---|
| 1,011,954 | 12/1911 | Herr | 451/353 |
| 2,953,807 | 9/1960 | Nilsson | 15/385 |
| 4,715,087 | 12/1987 | Todd et al. . | |
| 4,720,886 | 1/1988 | McLeod et al. . | |
| 4,731,956 | 3/1988 | Wood . | |
| 4,805,258 | 2/1989 | Sitarski et al. . | |
| 4,881,288 | 11/1989 | May et al. . | |
| 5,058,229 | 10/1991 | Plazanet | 451/353 |

FOREIGN PATENT DOCUMENTS

| | | | |
|---|---|---|---|
| 79818 | 12/1962 | France | 451/353 |

OTHER PUBLICATIONS

Product Brochure from Tennant Trend, "The 201 Scrubbisher®", LITHO in USA 12/92–15M 100–032, 4 pages.

Product Brochure from Tennant Trend, "The 2500XP & 2500XPD Burnishers", Part #100–029 Litho USA, 4 pages, (not dated).

Nobles Industries, Inc., "Speedshine®2000 Dust Control Burnisher", 2 pages, 1993.

Centaur, "Swift The 2000 RPM Burnisher", pages, (not dated).

*Primary Examiner*—David Scherbel
*Assistant Examiner*—Randall E. Chin
*Attorney, Agent, or Firm*—Price, Heneveld, Cooper, DeWitt and Litton

[57] ABSTRACT

A floor burnisher having a frame, a peripheral housing, rear wheels and a front caster, the housing having an internal cylindrical wall defining a vertical chamber having an open bottom; a floating rotational drive motor in the chamber, and a rotational pad-driver underlying and connected to the motor to be rotationally driven thereby for mounting a flexible burnishing pad; suspension links and springs between the frame and drive motor suspending the drive motor, pad-driver and pad thereon in a floating fashion relative to the frame and housing, allowing limited vertical movement relative to the cylindrical wall; a flexible, peripheral, floor-engagement skin suspended from the peripheral housing shroud, and an air flow control sealing member between the motor and annular wall for preventing excessive air flow between the floating motor and wall into the burnisher wall chamber. In one embodiment, the air flow control member is a wiper mounted on the motor and slidably engaging the wall to slide up and down the wall. In a second embodiment, the air flow control member is a diaphragm between the motor and housing. In a third embodiment, the air flow control member is a bellows between the motor and housing.

14 Claims, 4 Drawing Sheets

MOTOR AND DRIVER MOUNT DIAPHRAGM BURNISHER

BACKGROUND OF THE INVENTION

This invention relates to floor burnishers, and particularly to floor burnishers of the power cord type.

Burnishers for maintenance of floor services are known to have pad undersurface configurations that create a negative pressure thereunder during high speed rotation to thereby cause the burnisher, and therefore the burnishing pad, to lower and vigorously engage the floor surface while the burnisher is advanced over the floor surface. Floor surfaces are frequently less than perfectly level, however, having higher areas and lower areas. As conventional burnishers move across higher areas, the power required to operate the electric motor which rotationally drives the burnisher pad can readily increase from about 15 amperes up to 22 amperes, or in some situations even 30 amperes. This tremendous and sudden variation in power level demand can be troublesome to the electrical system as well as demanding on the motor windings.

Some burnishers have mechanisms for adjusting the height of the mechanism so as to somewhat regulate the extent to which the pad engages the floor, and thereby try to control excessive amperage variations. However, this does not significantly remove the difficulty since the choice is then between less than vigorous engagement with the floor and more effective engagement along with large amperage variations. Moreover, this adjustment is usually difficult to achieve with prior burnishers whether cord or battery type. The motor is fixed to the housing so that, with adjustment, the pad will be positioned at an angle to the floor rather than parallel to the floor. This is undesirable.

SUMMARY OF THE INVENTION

An object of this invention is to provide a novel burnisher that minimizes power demand variations as the burnisher travels over elevated floor surface areas, the amperage variation typically being only about plus or minus one ampere. In the novel burnisher, only the motor, pad-driver and pad are suspended, rather than the other components including the frame. Moreover, the motor, pad-driver and pad are suspended in a floating fashion. The motor and pad-driver are suspended such that the motor is vertically movable a limited amount within a surrounding peripheral wall formed by the burnisher housing, and slightly tiltable within the housing. A special seal between the motor and surrounding peripheral wall allows the motor movement while it effects a generally isolated chamber around the floating motor and pad-driver, to assure dust control flow through a peripheral passage in the housing to a removable retaining bag.

The frame and housing of the burnisher are supported on a pair of rear wheels and a front caster so as to remain vertically stable while the motor and pad-driver are free to float vertically suspended on springs. The caster is adjustable to allow limited vertical adjustment of the frame.

These and other objects, advantages and features of the invention will become apparent upon studying the following specification in conjunction with the drawings.

DESCRIPTION OF THE PREFERRED EMBODIMENTS

Figure 1:
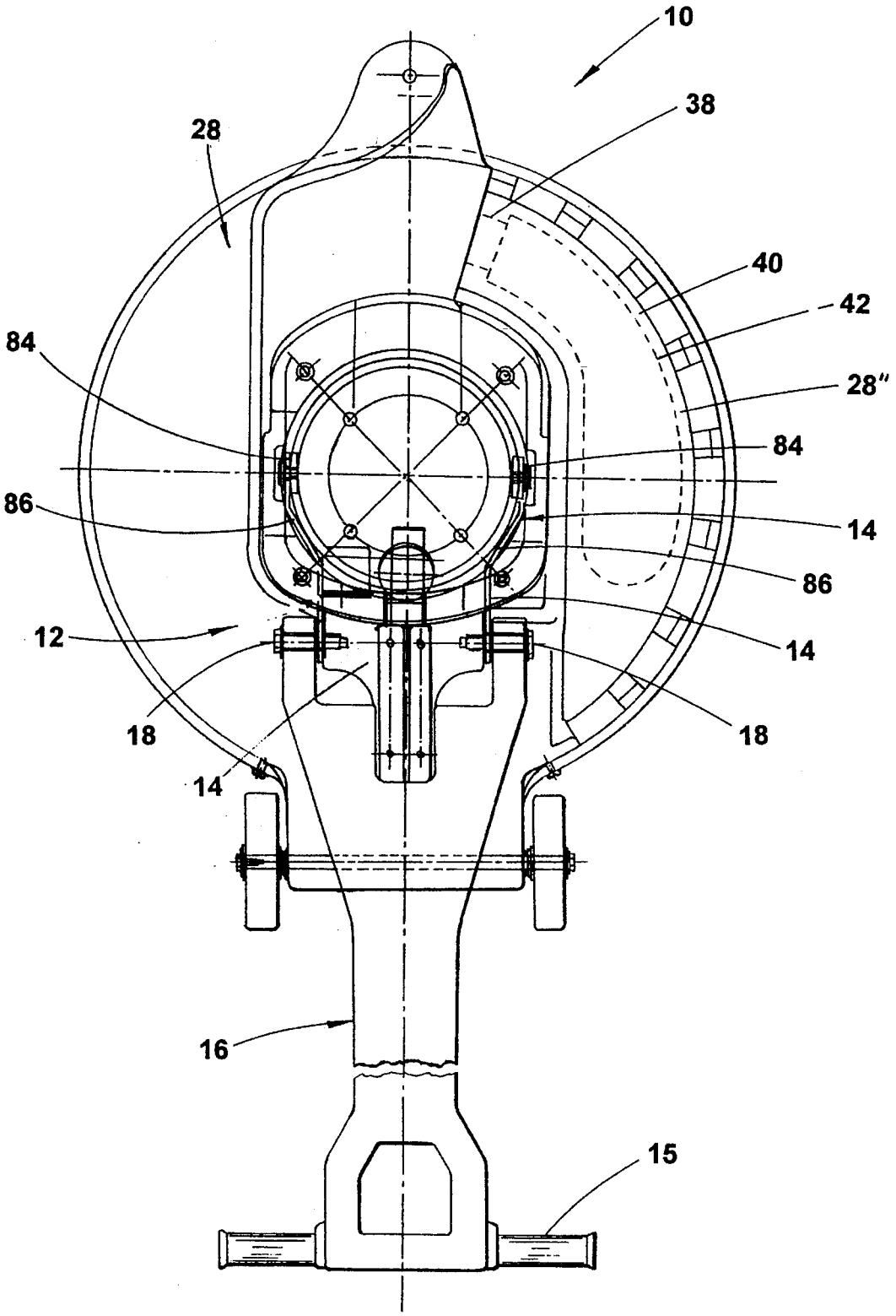
FIG. 1 is a top plan view of the novel burnisher.

Referring now specifically to the drawings, the novel burnisher assembly 10 comprises a frame 12 which includes a pair of rearwardly extending flanges 14 to which the handle subassembly 16 is mounted by a pair of pivot bolts or pins 18. The handle subassembly includes hand grips 15 on the upper end along with control buttons (not shown) of conventional type. On the handle subassembly is a handle position retainer 20 (FIG. 2) which is movable axially of the elongated handle subassembly 16, to engage at the lower end in selected slots 22 of an arcuately shaped segment 24. Thus the handle position is lockable between various elevated and lowered positions as shown, for example, by the solid line elevated position (FIG. 2) when the burnisher is not being used, and a selected lowered dotted line position when the burnisher is in use. Mounted on the frame is a shroud-type housing 28 preferably of polymeric material formed as by reaction injection molding techniques. This housing defines and extends above and around a burnishing pad chamber 30 open at the bottom of the structure. The top of this chamber is enclosed by polymeric upper surface 28' while the periphery is preferably enclosed by a depending, flexible, annular skirt 32 mounted at its upper edge to the housing. The lower edge of peripheral skirt 32 is for engaging the floor surface to be burnished. Housing 28 also defines an annular air and dust flow duct 34 which has an inlet from chamber 30 and an outlet 38 to chamber 40 (FIG. 1). Chamber 40 receives a flexible dust bag 42 removably mounted to outlet 38 for collection of dust generated during the burnishing operation. Chamber 40 is normally covered by a removable cover 28" forming part of housing 28.

Figure 2:
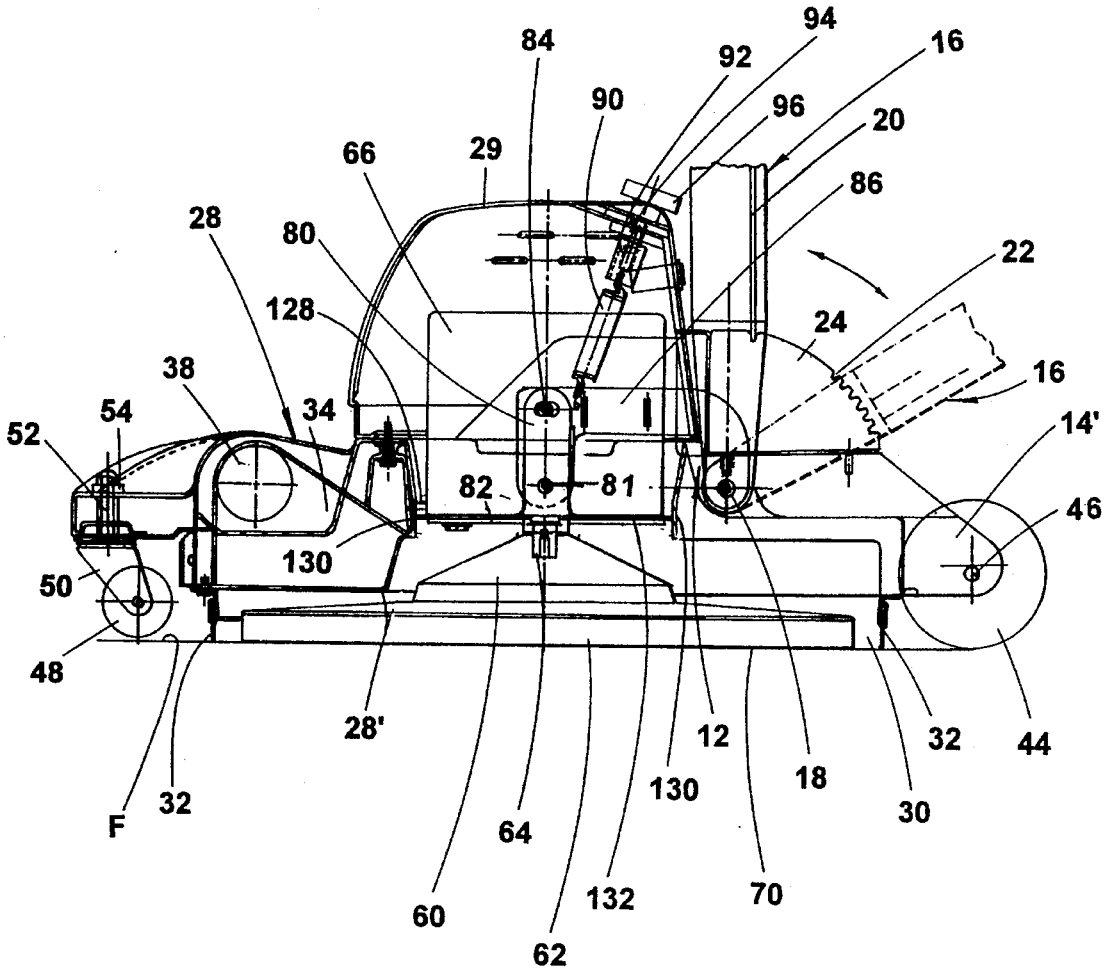
FIG. 2 is a side elevational, sectional view of the novel burnisher.

The burnisher housing and frame are mounted on a pair of laterally spaced rear wheels 44 rotational on transverse axle 46. Axle 46 is supported by the rearwardly extending portion of the frame and housing (FIG. 2). The front end of the housing and frame is supported by a pivotal caster 48 having a pair of mounting ears 50 supported on vertical swivel shaft 52 which extends upwardly through the housing and is vertically adjustable as by a fastener 54.

Within chamber 30 is a burnisher hub 60 which mounts a conventional rotational pad driver 62 therebelow, and is in turn mounted on a driven rotational vertical shaft 64 extending downwardly from electric motor 66. The cylindrical motor is shown covered by a removable motor cover 29.

The underside of pad driver 62 mounts a removable burnishing pad 70 of conventional type. The pad driver and burnishing pad are flexible such that during operation the pad can move from an elevated position above a floor surface F, down into full working engagement with the floor surface. This downward movement is against the bias of tension springs 90 (explained below) and is caused by the conventional configurated undersurface of the pad which creates an air pumping action to result in a negative pressure in chamber 30 when rotated at high speed, serving to draw the pad down into burnishing engagement with the floor surface. Because this pad surface is conventional and known to those in the art, it is not necessary to show the details thereof.

Motor 66, hub 60 and pad driver 62 are suspended by a first pair of vertically oriented suspension brackets 80, the lower ends of which are integral with and astraddle a horizontal motor plate 82 on which motor 66 is mounted. Brackets 80 are pivotally attached at 81 near the bottom ends of the inner legs of inverted U-shaped links 86. The upper ends of brackets 80 are mounted on pins 84 to the forward ends of the cross legs of the pair of cooperative, inverted, U-shaped mounting links 86, but with a slotted connection to allow angular adjustment of the pad driver. Specifically, the upper ends of suspension brackets 80 have horizontally elongated arcuate slots therein which extend fore and aft of the burnisher, receiving transversely oriented pins 84 of mounting links 86. Free vertical movement of a limited amount is allowed for the motor 66, links 80 and pad driver 62. The rear ends of the U-shaped links 86 are attached to fixed side pins or bolts 18 on the frame. Resilient vibration dampeners are also preferably provided at this connection.

A pair of tension coil springs 90 biases links 86 upwardly, thereby biasing brackets 80, motor 66, hub 60 and pad driver 62 upwardly. The lower ends of these springs are attached to mounting links 86 between the ends of the links, and nearer the forward ends of the cross legs of links 86, adjacent pivot pins 84. The upper ends of springs 90 are attached to a collar 92 mounted on screw shaft 94, the top of which has turning knob 96 located on and outside of cover 29. By rotating knob 96, collar 92 can be vertically adjusted up or down, to thereby put more or less tension on springs 90, and thereby fine-tune adjust the biased floating characteristics of the motor and burnishing components.

Figure 2A:
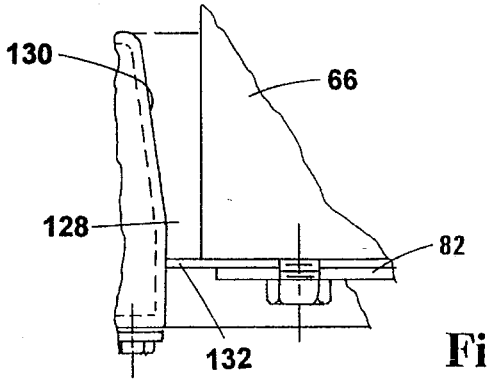
FIG. 2A is a fragmentary, enlarged, sectional view of a portion of the burnisher in FIG. 2.
Figure 3:
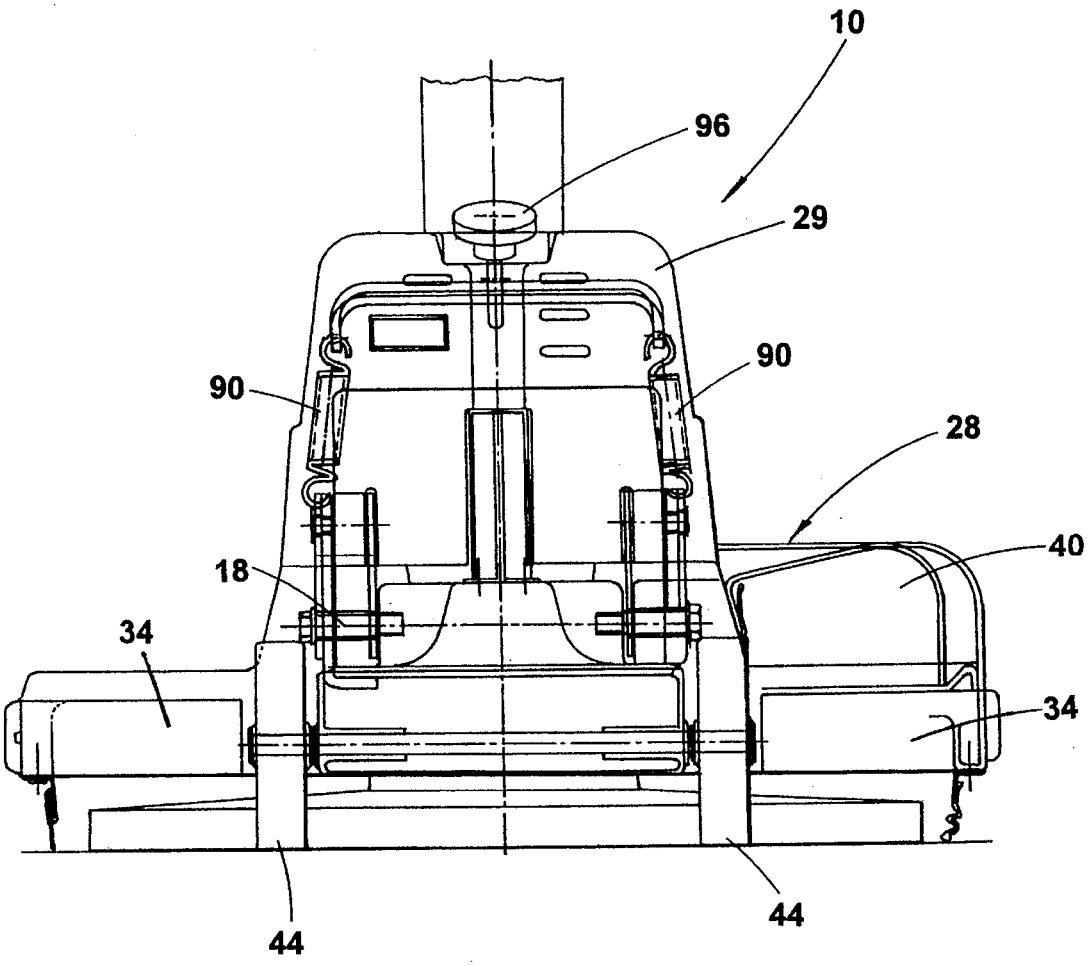
FIG. 3 is a rear elevational view of the lower portion of the burnisher, clearly depicting the first seal embodiment, a sliding seal.

Motor 66 is suspended within a vertical cylindrical chamber 128 that extends around motor 66 to surround it with a generally cylindrical upstanding wall 130. The motor periphery is smaller than the chamber 128 to leave a space therebetween. Mounted to the bottom of motor 66 in the first embodiment depicted in FIG. 2 is a circular seal plate 132 which has a diameter larger than that of motor 66 and substantially equal to that of the surrounding cylindrical chamber 128 and wall 130, to form a sliding seal arrangement with wall 130 when motor 66 moves a limited amount vertically up or down within the housing. Circular seal plate 132 is shown retained on the base of motor 66 by a smaller underlying plate 82 (FIG. 2A). Bolts 135 extend up through plates 82 and 132 to be threadably attached to motor 66. When the novel burnisher is actuated, the ribbed pad performs like an air impeller on a fan or pump to propel air out of the chamber 30 and thereby form a negative pressure, i.e., partial vacuum, in this chamber. This draws the pad, pad driver, hub and motor downwardly for floor engagement, as seal plate 132 slides along the inner diameter peripheral surface of wall 130 a small amount to seal off the annular space between the motor and housing, and thereby prevent excessive air flow being drawn into chamber 30 to release its vacuum. Rather, the pad propels air and dust discharge through the annular duct and outlet 38 into the disposable, flexible bag 42 in bag chamber 40. A small amount of replacement air enters beneath curtain 32.

Experimental use with the novel burnisher has determined that, in sharp contrast to known burnishers, the power amperage drawn by the burnisher when traversing a high spot in the floor surface F varies only about plus or minus one ampere, as opposed to up to 15 amperes or so in prior devices. The burnisher effectively floats over the surface, being free to move vertically and tilt slightly independently of the housing and frame which are supported by the wheels 44 and caster 48, for smooth yet effective burnishing operation.

Figure 4:
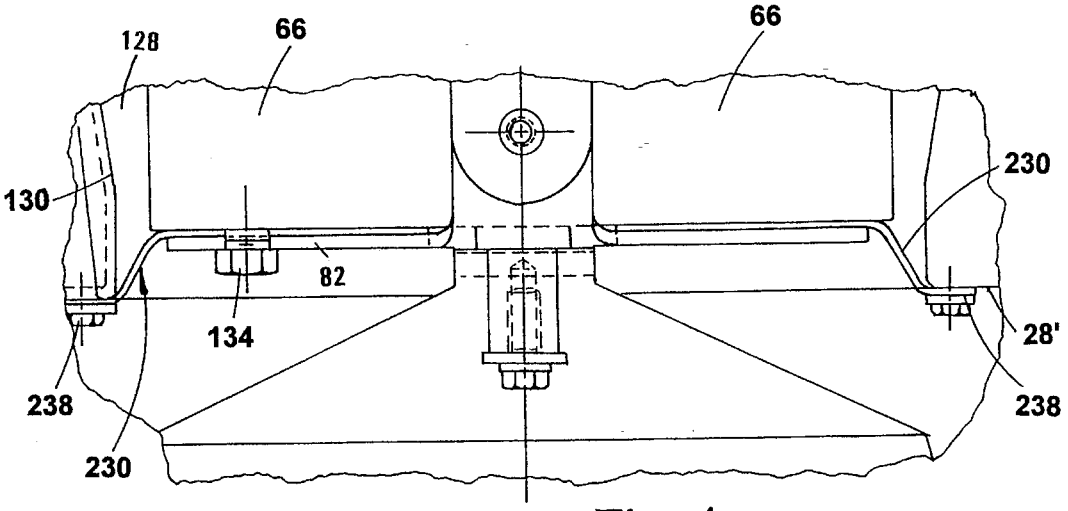
FIG. 4 is an enlarged, sectional, fragmentary view of a second seal embodiment and a portion of the burnisher.

Conceivably the seal between motor 66 and surrounding cylindrical wall 130 could be other than the sliding seal arrangement shown. Specifically, referring to FIG. 4, an alternative embodiment is depicted wherein, instead of sliding seal 130, there is a flexible diaphragm 230 mounted beneath motor 66 and housing 28. A plate 82 secures the diaphragm to motor 66 by bolts 134. The outer edge of the diaphragm extends beyond motor 66 and is attached to the surrounding annular undersurface 28' of housing 28 as by bonding and/or bolt type fasteners 238 or the equivalent.

Figure 5:
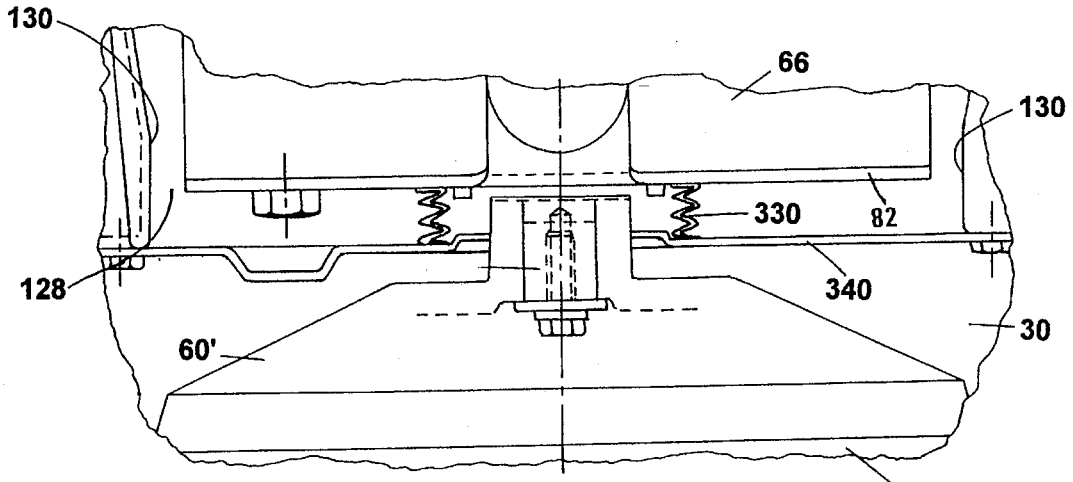
FIG. 5 is an enlarged, sectional, fragmentary view of a third seal embodiment and a portion of the burnisher.

A third embodiment of a seal between housing 28 and motor 66 is depicted in FIG. 5. The housing includes a closure plate 340 that extends across the open base of cylindrical opening 128 to enclose it, with motor shaft 64 extending down through an opening in the center of closure plate 340 to mount to the hub 60' of pad driver 62. Extending between plate 340 and the support plate 82 in the bottom of motor 66 is an annular, generally cylindrical, sealing bellows 330 which is vertically flexible so that excessive air is not drawn between motor 66 and peripheral wall 130, but rather a small controlled amount of air enters under the peripheral curtain and flows through the housing to the dust bag.

Conceivably those having skill in this field will consider other variations or embodiments equivalent to the disclosed embodiments and operable to achieve the unique operation including the novel seal action of the burnisher with the floating motor and pad driver. Hence, the invention is not intended to be limited to the preferred embodiments set forth, but only by the scope of the appended claims and the legal equivalents thereto.

The embodiments of the invention in which an exclusive property or privilege is claimed are defined as follows:

1. A floor burnisher comprising:

a frame including a peripheral housing, rear wheels and a front caster;

said housing having an internal wall defining a vertical chamber having an open bottom;

a suspended, floating, rotational drive motor in said chamber, and a rotational pad-driver underlying and connected to said motor to be rotationally driven thereby, said pad-driver having means for mounting a burnishing pad thereon;

suspension elements connected between said frame and said drive motor suspending said drive motor and said pad-driver and any pad thereon in a manner allowing said floating drive motor and underlying pad-driver to have limited vertical movement relative to said wall of said housing;

a flexible, peripheral, floor-engagement skirt suspended from said peripheral housing to control air flow to said pad-driver; and an air flow seal between said motor and said wall for limiting air flow between said motor and said wall even when said motor moves vertically relative to said wall and said housing, whereby a negative pressure created at said pad-driver and a burnishing pad thereon, when rotated, will cause said motor and pad-driver to move downwardly to burnish a floor.

2. The floor burnisher in claim 1 wherein said wall is a cylindrical wall and said air flow seal comprises a wiper in engagement with said cylindrical wall.

3. The floor burnisher in claim 2 wherein said wiper is mounted on said motor and slidably engages said cylindrical wall.

4. The floor burnisher in claim 3 wherein said wiper is slidable up and down on said wall with vertical movement of said motor.

5. The floor burnisher in claim 1 wherein said air flow seal comprises a flexible diaphragm between said motor and said housing.

6. The floor burnisher in claim 1 wherein said air flow seal comprises a flexible bellows between said motor and said housing.

7. The floor burnisher in claim 1 wherein said suspension elements comprise mounting links and springs.

8. The floor burnisher in claim 7 wherein said mounting links comprise U-shaped links straddling said motor.

9. The floor burnisher in claim 7 wherein said springs comprise a pair of tension springs between said housing and said links.

10. The floor burnisher in claim 7 wherein said springs are connected to said mounting links between the ends of said mounting links.

11. The floor burnisher in claim 10 including suspension brackets connected to said motor and to said mounting links.

12. The floor burnisher in claim 11 wherein said suspension brackets have a limited pivotal connection to said mounting links to enable angular variation of said pad driver relative to a floor surface.

13. The floor burnisher in claim 7 wherein said suspension elements have a limited pivotal connection to enable angular variation of said pad driver relative to a floor surface.

14. The floor burnisher in claim 1 wherein said front caster is vertically adjustable.

* * * * *